US006601843B2

(12) United States Patent
Miki

(10) Patent No.: US 6,601,843 B2
(45) Date of Patent: Aug. 5, 2003

(54) SHEET FEEDING DEVICE AND IMAGE FORMING APPARATUS USING THE SHEET FEEDING DEVICE

(75) Inventor: Katsuhiko Miki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/029,258

(22) Filed: Dec. 28, 2001

(65) Prior Publication Data

US 2002/0096817 A1 Jul. 25, 2002

(30) Foreign Application Priority Data

Dec. 28, 2000 (JP) ..... 2000-400698
Nov. 30, 2001 (JP) ..... 2001-366526

(51) Int. Cl.[7] ..... B65H 5/00
(52) U.S. Cl. ..... 271/10.13; 271/4.02; 271/4.08
(58) Field of Search ..... 271/4.01, 4.07, 271/4.08, 4.1, 10.01, 10.04, 10.09, 10.11, 10.13, 122; B65H 5/22

(56) References Cited

U.S. PATENT DOCUMENTS 5,474,287 A * 12/1995 Takahashi ..... 271/10.13
5,755,435 A * 5/1998 Fujiwara ..... 271/4.04
5,975,516 A * 11/1999 Maruchi et al. ..... 271/10.12

FOREIGN PATENT DOCUMENTS

JP 6-9079 1/1994
JP 8-59000 3/1996

* cited by examiner

*Primary Examiner*—Donald P Walsh
*Assistant Examiner*—Kenneth W Bower
(74) *Attorney, Agent, or Firm*—Oblon, Spivak, McClelland, Maier & Neustadt, P.C.

(57) ABSTRACT

A sheet feeding device including a sheet tray accommodating stacked sheets, and a sheet feeding unit feeding the stacked sheets in the sheet tray one by one. The sheet feeding unit includes a feeding roller which rotates in a sheet feeding direction, and a separation roller which presses against the feeding roller when feeding each of the stacked sheets and which rotates, via a torque limiter, in a direction opposite the sheet feeding direction. The separation roller is rotated by rotation of the feeding roller when a single sheet is sandwiched between the feeding and separation rollers. Also included is a conveying member arranged downstream of the feeding roller in the sheet feeding direction, and a driving source which drives each of the feeding roller, the separation roller, and the conveying member via a driving force transmission mechanism so the separation roller and the conveying member are driven in conjunction with each other.

52 Claims, 13 Drawing Sheets

FIG. 9

| | | DRIVING STATE OF EACH SHEET FEEDING DEVICE | | | |
|---|---|---|---|---|---|
| | | 11 | 12 | 13 | 14 |
| SELECTED SHEET FEEDING DEVICE | 11 | H | × | × | × |
| | 12 | L | H | × | × |
| | 13 | L | L | H | × |
| | 14 | L | L | L | H |

H: SELECTED FOR SHEET FEEDING, AND MOTOR ROTATED FORWARD/IN REVERSE

L: MOTOR ROTATED IN REVERSE

×: MOTOR NOT DRIVEN

FIG. 12

| SELECTED SHEET FEEDING DEVICE | DRIVING STATE OF EACH SHEET FEEDING DEVICE 11 | 12 | 13 | 14 |
|---|---|---|---|---|
| 11 | ● | × | × | × |
| 12 | ○ | ● | × | × |
| 13 | ○ | × | ● | × |
| 14 | ○ | × | × | ● |

●: SELECTED FOR SHEET FEEDING, AND MOTOR ROTATED FORWARD/IN REVERSE

○: MOTOR ROTATED IN REVERSE

×: MOTOR NOT DRIVEN

SHEET FEEDING DEVICE AND IMAGE FORMING APPARATUS USING THE SHEET FEEDING DEVICE

CROSS-REFERENCE TO RELATED APPLICATIONS

The present application claims priority and contains subject matter related to Japanese Patent Applications No. 2000-400698, and No. 2001-366526 filed in the Japanese Patent Office on Dec. 28, 2000 and Nov. 30, 2001, respectively, and the entire contents of which are hereby incorporated by reference.

BACKGROUND OF THE INVENTION

1. Field of the Invention

The present invention relates to a sheet feeding device for use in image forming apparatuses, such as copying machines, printers, facsimile apparatuses, printing apparatuses, etc., and an image forming apparatus using the sheet feeding device.

2. Discussion of the Background

In sheet feeding devices for image forming apparatuses, various methods have been proposed for separating stacked sheets so as to be fed one by one. A friction separation method is one of the well known methods. A sheet feeding device using a friction separation method generally includes a feeding roller which rotates in a sheet feeding direction, a separation roller which is pressed against the feeding roller and which is driven, via a torque limiter, to rotate in a direction opposite the sheet feeding direction, and a conveying roller arranged downstream of the feeding roller and the separation roller in the sheet feeding direction. When one sheet is sandwiched between the feeding roller and the separation roller, the separation roller is rotated by rotation of the feeding roller via the torque limiter, and when two or more sheets are sandwiched between the feeding roller and the separation roller, the sheets are separated from each other so as to be fed one by one because the separation roller is rotated in the opposite direction relative to the sheet feeding direction.

In a sheet feeding device using a friction separation method, driving a feeding roller, a separation roller and a conveying roller with individual driving sources is not desirable because of cost. Therefore, a feeding roller, a separation roller and a conveying roller is usually driven with a single driving source. Each of the rollers is connected or disconnected from the single driving source using, for example, an electromagnetic clutch and a solenoid. However, in an electric clutch, an inferior operation of the sheet feeding device may occur depending upon the amount of driving load for the connection and/or the disconnection, by variation in the periods of connection and/or disconnection of the driving source with each of the rollers with the electric clutch or by slippage in the clutch. This adversely influences the sheet conveying property of the sheet feeding device and causes sheet jamming in the sheet feeding device.

The above-described disadvantage in using an electric clutch in a sheet feeding device is addressed in Japanese Patent Laid-open Publication No. 8-59000. In JP No. 8-59000, a plurality of sheet feeding devices are provided in multiple-stages, and each of the sheet feeding devices includes an individual sheet feeding unit. Further, in the sheet feeding unit, a feeding roller, a separation roller, and a conveying roller are driven using a mechanical clutch (such as a one-way clutch) by switching a single reversible motor between forward and reverse directions. Specifically, the feeding, separation and conveying rollers are driven when the motor rotates in the forward direction, and only the conveying roller is driven at a high speed when the motor rotates in the reverse direction. Additionally, in the sheet feeding device of JP No. 8-59000, because the separation roller is stopped together with the feeding roller when rotation of the motor is reversed, if a subsequent sheet is stuck to a part of a sheet being fed (due to static electricity, etc.), the subsequent sheet may be fed together with the sheet being fed, resulting in a so-called double feeding of sheets.

SUMMARY OF THE INVENTION

Accordingly, one object of the present invention, is to solve the above-noted and other problems.

Another object of the present invention is to provide a novel sheet feeding device and image forming apparatus that includes a driving force transmitting mechanism that does not use an electric clutch and avoids double feeding of sheets.

To achieve these and other objects, the present invention provides a novel sheet feeding device including a sheet tray configured to accommodate stacked sheets, and a feeding unit configured to feed the stacked sheets in the sheet tray one by one. The sheet feeding unit includes a feeding roller configured to be driven to rotate in a sheet feeding direction in which each of the stacked sheets is fed, and a separation roller configured to be pressed against the feeding roller when feeding each of the sheets and to be driven to rotate, via a torque limiter, in a direction opposite the sheet feeding direction. The separation roller is rotated by rotation of the feeding roller in the sheet feeding direction when a single sheet of the stacked sheets is sandwiched between the feeding roller and the separation roller. The sheet feeding unit further includes a conveying member arranged downstream from the feeding roller in the sheet feeding direction, a driving source configured to drive the feeding roller, the separation roller, and the conveying member, and a driving force transmission mechanism configured to transmit a driving force to each of the feeding and separation rollers and the conveying member such that the separation roller and the conveying member are driven in conjunction with each other.

The present invention also provides an image forming apparatus using the above-noted sheet feeding device or a plurality of sheet feeding devices.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein:

FIG. 9 is a table indicating a driving state of each sheet feeding unit of multiple-staged sheet feeding devices when each of the sheet feeding devices is selected for sheet feeding;

FIG. 12 is a table indicating a driving status of each sheet feeding unit of the multiple-staged sheet feeding devices of FIG. 11.

DETAILED DESCRIPTION OF THE PREFERRED EMBODIMENTS

Figure 1:
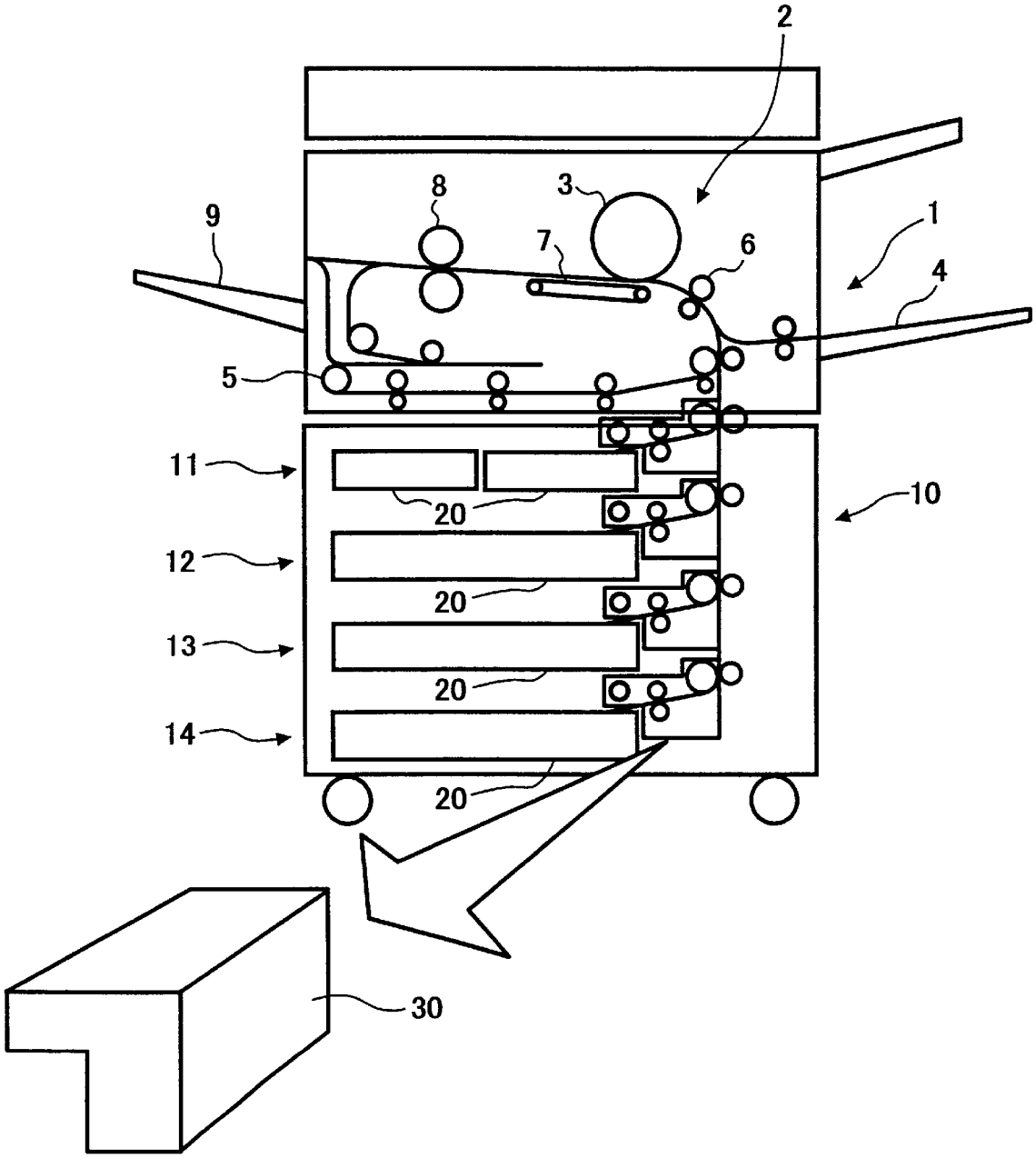
FIG. 1 is a schematic drawing of an image forming apparatus including a plurality of sheet feeding devices according to a preferred embodiment of the present invention.

Referring now to the drawings, wherein like reference numerals designate identical or corresponding parts throughout the several views, preferred embodiments of the present invention are described.

FIG. 1 is a schematic drawing of an image forming apparatus including a plurality of sheet feeding devices according to a preferred embodiment of the present invention. In FIG. 1, numeral 1 denotes a main body of the image forming apparatus, in which an image forming part 2 is provided. The image forming part 2 includes a photoconductor drum 3 as an image bearing member, and performs image formation according to a known electrophotography process.

Further, a sheet feeding part 10 including multiple-staged sheet feeding devices (four sheet feeding devices 11, 12, 13 and 14 in this embodiment), is arranged below the image forming part 2 to convey a sheet therefrom toward the image forming part 2. In addition, a manual sheet feeding device 4, and a sheet reversing unit 5 for forming images on both sides of a sheet are provided in the main body 1 of the apparatus.

In the above-described image forming apparatus, a sheet fed out from the sheet feeding part 10 or fed from the manual sheet feeding device 4 is conveyed to a registration roller 6, and is then conveyed to a transfer part of the image forming part 2 by the registration roller 6 in synchronism with a timing that a toner image formed on a surface of the photoconductor drum 3 is moved to the transfer part.

Additionally, a transferring belt 7 is provided at the transfer part. The toner image is transferred onto the sheet conveyed to the transfer part by the transferring belt 7, and at the same time the sheet is conveyed by movement of the transferring belt 7 to a fixing device 8. The toner image is fixed onto the sheet at the fixing device 8, for example, by a heat and pressure operation. The sheet is then selectively conveyed to a sheet discharging part 9 or to the reversing unit 5.

Figure 2:
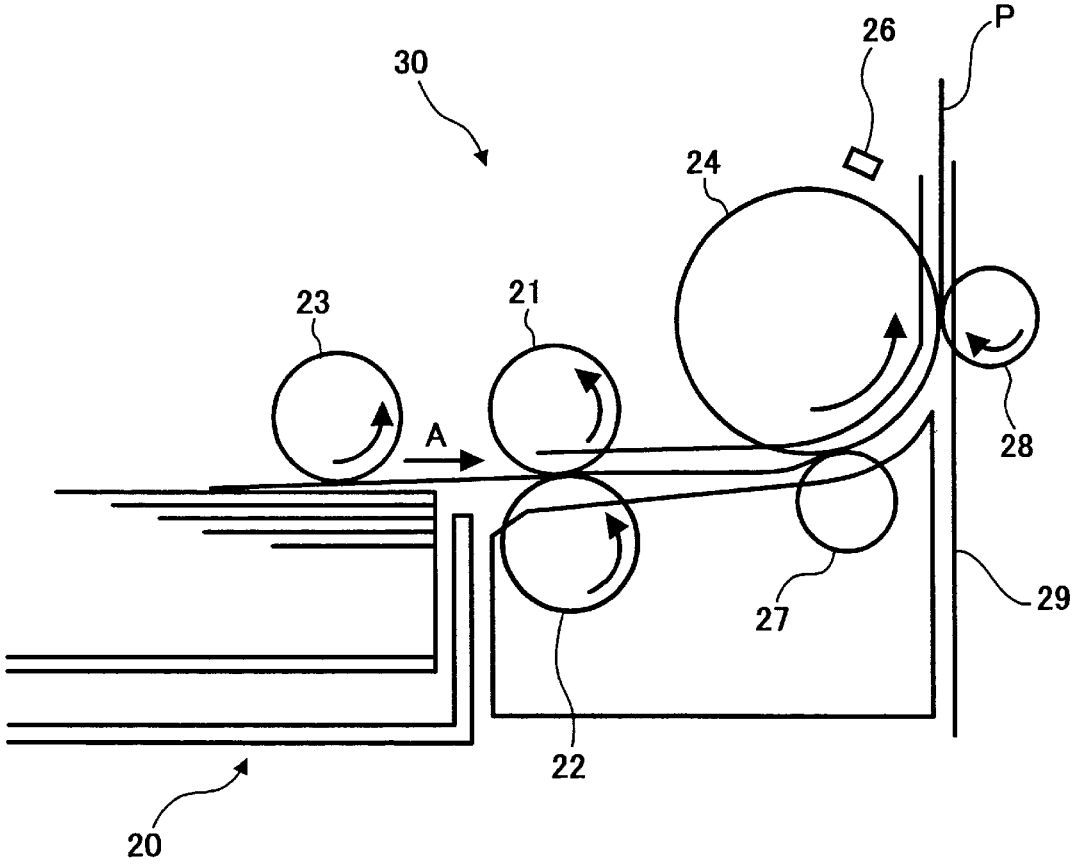
FIG. 2 is an enlarged schematic drawing of a sheet tray and a sheet feeding unit of each of the sheet feeding devices.
Figure 3:
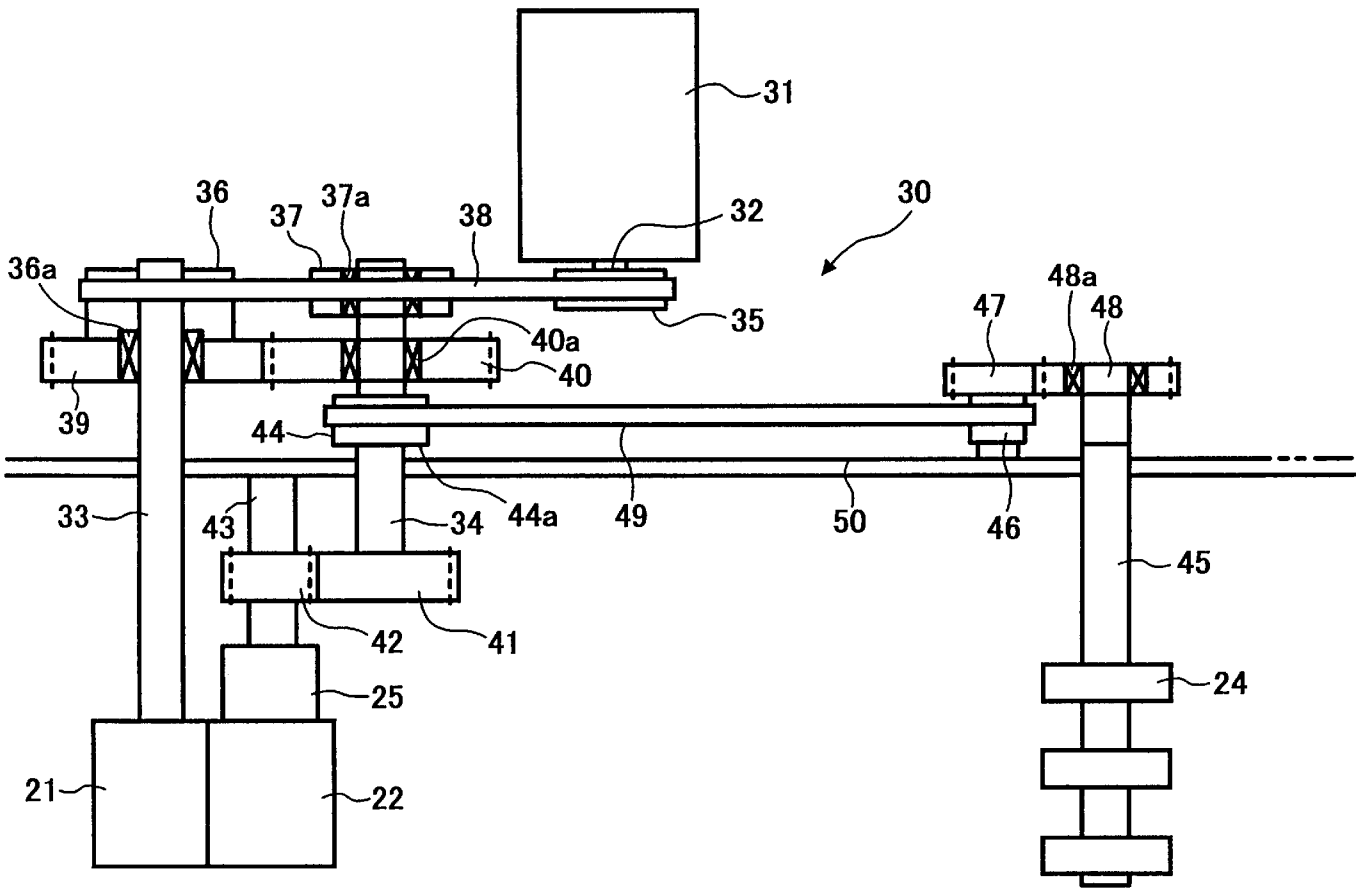
FIG. 3 is a schematic drawing of the sheet feeding unit.

FIG. 2 is an enlarged schematic drawing illustrating a sheet tray accommodating stacked sheets and a sheet feeding unit of each of the sheet feeding devices 11–14 of the sheet feeding part 10. FIG. 3 is a schematic drawing illustrating a driving force transmission mechanism of the sheet feeding unit.

Each of the sheet feeding devices 11–14 employs a friction separation method and includes, as illustrated in FIGS. 1 and 2, a sheet tray 20 configured to accommodate stacked sheets, and a sheet feeding unit 30 configured to feed the stacked sheets one by one. As shown in FIG. 2, the sheet feeding unit 30 includes a feeding roller 21 configured to be driven to rotate in a sheet feeding direction in which a sheet P is fed, a separation roller 22 configured to be pressed against the feeding roller 21 when feeding the sheet P and to be driven via a torque limiter (not shown in FIG. 2) to rotate in a sheet returning direction in which the sheet P is returned. Also included is a pick-up roller 23 arranged on the stacked sheets in the sheet tray 20 and configured to rotate in the sheet feeding direction to feed the sheet P from the sheet tray 20, and a conveying roller 24 serving as a conveying member for further conveying the sheet P fed by the feeding roller 21.

In each of the sheet feeding devices 11–14, when starting a sheet feeding operation, the pick-up roller 23 (to which a driving force of the feeding roller 21 is transmitted) first feeds an uppermost sheet P of the stacked sheets in the sheet tray 20 in a direction indicated by an arrow A. The fed sheet P is then sandwiched between the feeding roller 21 and the separation roller 22 at a nip thereof. At this time, when the fed sheet P is a single sheet, the separation roller 22 is rotated by a conveying force of the feeding roller 21 so the sheet P is fed in the sheet feeding direction. The sheet P is further conveyed by the conveying roller 24 to the registration roller 6.

When plural sheets P are fed between the feeding roller 21 and the separation roller 22, the separation roller 22 rotates in the sheet returning direction because a predetermined torque is given to the separation roller 22 in the sheet returning direction. Thereby, the sheet P contacting the separation roller 22 is returned and only the uppermost sheet P of the plural sheets P is fed by the feeding roller 21. In FIG. 2, numerals 27 and 28 denote driven conveying rollers contacting the conveying roller 24.

Although only one sheet feeding unit 30 is illustrated in FIG. 3, it should be appreciated that a sheet feeding unit is included in each sheet feeding devices 11–14. Further, the sheet feeding unit 30 includes, as illustrated in FIG. 3, a motor 31 serving as a driving source. In this embodiment, a stepping motor rotatable in two directions (i.e., first and second directions) is used for the motor 31. A driving force of the motor 31 is transmitted via a driving force transmission mechanism (described below) to the feeding roller 21, the separation roller 22, and the conveying roller 24. In addition, the feeding, separation and conveying rollers 21, 22 and 24 are supported by a frame 29 (see FIG. 2) of the sheet feeding unit 30.

Now, referring to FIG. 3, the driving force transmission mechanism of the sheet feeding unit 30 will be described. As shown, a timing pulley 35 is provided to an output axis 32 of the motor 31, a timing pulley 36 having a gear 39 is provided to a driving axis 33 of the feeding roller 21, a timing pulley 37 is provided to a driving axis 34 of the separation roller 22, and a timing belt 38 is spanned around the timing pulleys 35, 36 and 37. Further, as shown in FIG. 4, the timing belt 38 is spanned around the timing pulleys 35, 36 and 37 in a triangle when viewed from the front of the image forming apparatus.

Figure 4:
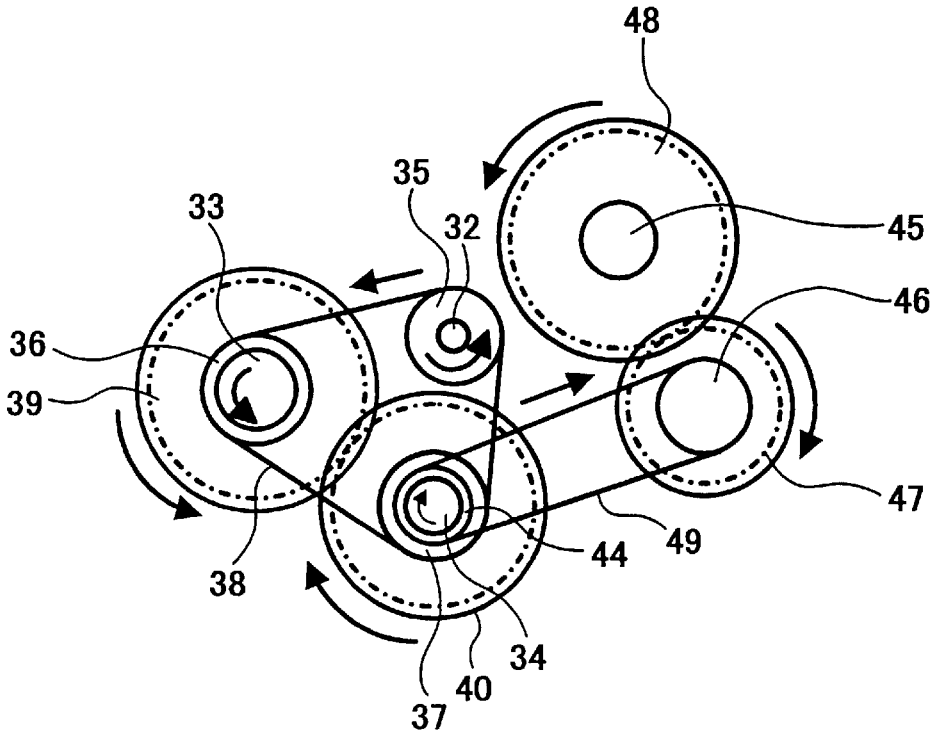
FIG. 4 is a front view of the sheet feeding unit.

With reference to FIGS. 3 and 4, a driving force of the motor 31 is conveyed from the timing pulley 35, via the timing belt 38 and the timing pulley 36 having a gear 39, to the driving axis 33 of the feeding roller 21, and from the timing pulley 35, via the timing belt 38 and the timing pulley 37, to the driving axis 34 of the separation roller 22. In FIG. 3, numeral 25 denotes a torque limiter.

In addition, one-way clutches 36*a* and 37*a* are provided to the timing pulley 36 having the gear 39 and to the timing pulley 37, respectively. Further, a gear 40 engaging with the gear 39 of the pulley 36 is provided to the driving axis 34 of the separation roller 22, and a one-way clutch 40*a* is provided to the gear 40. The one-way clutch 36*a* is configured to be locked relative to a direction in which the timing belt 38 is rotated when the motor 31 is driven to rotate in the first direction (hereinafter, the forward direction), so that a driving force of the motor 31 is transmitted. In this rotation direction of the timing belt 38, the one-way clutch 37*a* does not transmit the driving force of the motor 31. Further, the one-way clutch 40*a* transmits the driving force of the motor 31 when the driving axis 33 of the feeding roller 21 is rotated by driving the motor 31 to rotate in the forward direction.

Accordingly, when the motor 31 is driven to rotate in the forward direction, the driving axis 33 of the feeding roller 21 is driven to rotate via the output axis 32, the timing belt 38, and the pulley 36 having the gear 39. Further, the driving force of the motor 31 is transmitted to the driving axis 34 of the separation roller 22 via the pulley 36 having the gears 39 and 40. In addition, when the motor 31 is driven to rotate in the forward direction, the one-way clutch 37*a* is idle. Therefore, the driving force of the motor 31 is not transmitted to the driving axis 34 of the separation roller 22 via the timing pulley 37. Accordingly, when the motor 31 is driven to rotate in the forward direction, the feeding roller 21 and the separation roller 22 are both driven to rotate. The first driving force transmission route according to this embodiment includes the route in which the driving force of the motor 31 is transmitted to the driving axis 34 of the separation roller 22 via the timing belt 38 and timing pulley 36 having the gears 39 and 40.

When the motor 31 is driven to rotate in the second direction (hereinafter, the reverse direction), in the direction in which the timing belt 38 moves at this time, the one-way clutch 36*a* does not transmit a driving force of the motor 31, so the driving axis 33 of the feeding roller 21 does not rotate. On the other hand, because the one-way clutch 37*a* of the driving axis 34 of the separation roller 22 transmits the driving force of the motor 31 at that time, the driving force of the motor 31 is transmitted via the timing belt 38 and the timing pulley 37 to the driving axis 34 of the separation roller 22, so the separation roller 22 is driven to rotate.

At this time, because the one-way clutch 40*a* does not transmit a driving force of the driving axis 34, the gear 40 does not rotate and thus a rotation of the driving axis 34 of the separation roller 22 is never transmitted to the driving axis 33 of the feeding roller 21 via the gear 40 and the timing pulley 36 having the gear 39. Here, a second driving force transmission route according to the embodiment includes the route in which a driving force of the motor 31 is transmitted to the driving axis 34 of the separation roller 22 via the timing belt 38 and the timing pulley 37.

Thus, the driving axis 33 of the feeding roller 21 is configured to be driven to rotate only when the motor 31 rotates in the forward direction, and the driving axis 34 of the separation roller 22 is configured to be driven to rotate when the motor 31 rotates in either of the forward and reverse directions. Further, a gear 41 is provided to the driving axis 34 of the separation roller 22, and the gear 41 engages with a gear 42 provided to a driven axis 43 to which the separation roller 22 is mounted. By configuring the separation roller 22 as described above (i.e., by providing the separation roller 22 to the driven axis 43 instead of the driving axis 34 and connecting the driven axis 43 and the driving axis 34 with the gears 41 and 42), a separation pressure of the separation roller 22 relative to the feeding roller 21 may be adjusted by adjusting gear surface pressures of the gears 41 and 42.

In addition, a timing pulley 44 is provided to the driving axis 34 of the separation roller 22, and a gear 48 which engages with a gear 47 of a timing pulley 46 having a gear is provided to a roller axis 45 of the conveying roller 24. Further, a timing belt 49 is spanned around the timing pulley 44 and the timing pulley 46 having a gear. Thus, the conveying roller 24 rotates when the driving axis 34 of the separation roller 22 is driven to rotate. Accordingly, when the separation roller 22 is driven, the conveying roller 24 is driven to rotate.

Therefore, in each of the sheet feeding devices 11–14 having the sheet feeding unit 30, when a sheet feeding instruction is given, the motor 31 is rotated in the forward direction, and thereby the feeding roller 21, the separation roller 22, and the conveying roller 24 are driven to rotate in predetermined directions, respectively. Further, the pick-up roller 23 connected with the driving axis 33 of the feeding roller 21 via an idle gear (not shown) is driven to rotate in a predetermined direction with the forward rotation of the motor 31.

After a sheet fed by the pick-up roller 23 is separated from other sheets by the feeding roller 21 and the separation roller 22, the sheet is conveyed by the conveying roller 24. Once a sheet has been fed to the conveying roller 24, the sheet can be conveyed without driving the feeding roller 21 to rotate by rotating the conveying roller 24. Driving the feeding roller 21 should preferably be stopped while a sheet is sandwiched by the feeding roller 21 and the separation roller 22. Therefore, in this embodiment, as illustrated in FIG. 2, a sensor 26 is arranged downstream of the conveying roller 24 in the sheet conveying direction and in the vicinity thereof, so that when the sensor 26 detects a leading edge of the sheet, the direction of rotation of the motor 31 is switched from the forward direction to the reverse direction.

When the motor 31 is driven to rotate in the reverse direction, as described above, the feeding roller 21 is not driven to rotate, but the separation roller 22 and the conveying roller 24 continue to be driven until the sheet passes the conveying roller 24. Thus, the separation roller 22 and the conveying roller 24 are driven to rotate in conjunction with each other during a sheet feeding operation. Thus, even if a subsequent sheet is stuck to a part of the sheet to be fed by static electricity, etc., the subsequent sheet is returned by the separation roller 22, thereby preventing double feeding of sheets. Further, driving the separation roller 22 and the conveying roller 24 in conjunction with each other can be performed using individual driving sources (motors). However, it is advantageous to drive the separation roller 22 and the conveying roller 24 with a single driving source as in the above-described embodiment because of lower costs and a smaller driving source. Further, the one-way clutch 48*a* is provided to the gear 48, so that when the gear 48 rotates, rotation of the gear 48 is transmitted to the axis 45 of the conveying roller 24. Accordingly, even if the conveying roller 24 rotates via a sheet being conveyed, the rotation of the conveying roller 24 is not transmitted to the gear 48. In addition, the sheet feeding unit 30 is detachably mounted to each main body of the sheet feeding devices 11–14 allowing for simplified maintenance, etc.

Figure 5:
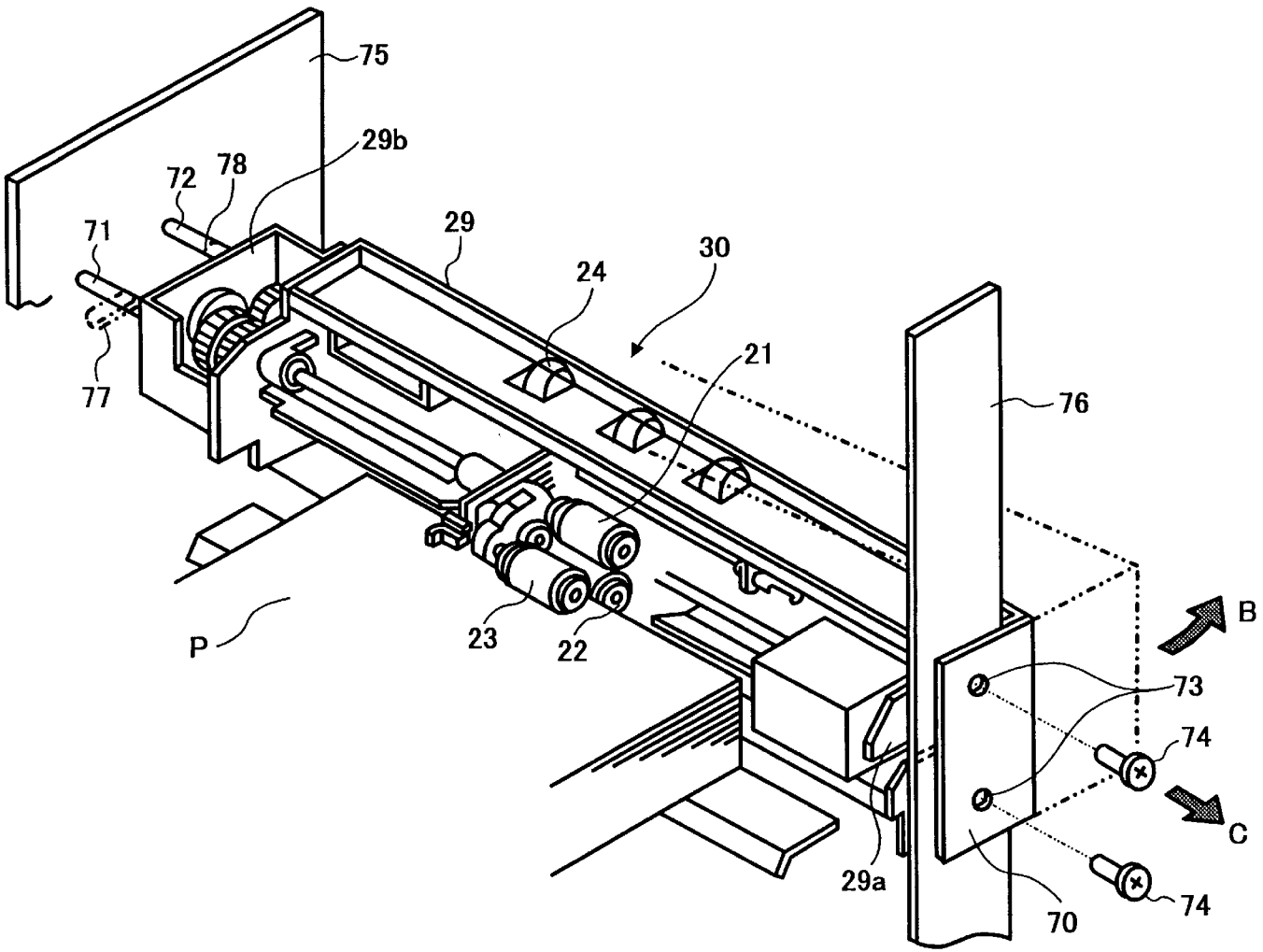
FIG. 5 is a schematic drawing illustrating an exemplary construction of the sheet feeding unit for detachably mounting the sheet feeding unit to a main body of the sheet feeding device.

Turning now to FIG. 5, which illustrates an exemplary construction of the sheet feeding unit 30 for detachably mounting the sheet feeding unit 30 to each main body of the sheet feeding devices 11–14. As illustrated in FIG. 5, the frame 29 of the sheet feeding unit 30 includes a front plate part 29*a* and a rear plate part 29*b*. An L-shaped mounting metal 70 is fixed to the front plate part 29*a* and two pins 71 and 72 are fixed to the rear plate part 29*b* extending in the axial direction of the feeding roller 21. A rear side plate 75 and a front side plate 76 are provided to the main body of the sheet feeding unit 30, and holes 77 and 78 are formed in the rear side plate 75 so the pins 71 and 72 are inserted therein respectively. The hole 77 is formed in an elongated form in a horizontal direction, screw holes 73 are formed in the mounting metal 70 for screw bolts 74, and screw holes (not shown) are formed in the front side plate 76 at positions corresponding to the screw holes 73.

Additionally, the sheet feeding unit 30 is supported by the rear side plate 75 with the pins 71 and 72 inserted into the holes 77 and 78 at the rear side of each of the sheet feeding devices 11–14, and at the front side by the front side plate 76 with the screw bolts 74 inserted into the screw holes 73 of the mounting metal 70 and the corresponding screw holes of the front side plate 76. Accordingly, when removing the sheet feeding unit 30 from each of the sheet feeding devices 11–14, the screw bolts 74 are first removed, and then the sheet feeding unit 30 is moved in a direction indicated by an arrow B, so the sheet feeding unit 30 is swung substantially around the pin 72.

After the sheet feeding unit 30 is moved to a position where the sheet feeding unit 30 does not interfere with the front side plate 76, the sheet feeding unit 30 may be removed from the corresponding sheet feeding device by drawing out the sheet feeding unit 30 in a direction indicated by an arrow C. Further, the hole 77 is formed in an elongated hole so the sheet feeding unit 30 can be easily swung in the direction indicated by the arrow B. The sheet feeding unit 30 can be attached to each of the sheet feeding devices 11–14 by performing the above-described procedures in the reverse order.

In the image forming apparatus of the present invention illustrated in FIG. 1, in which the sheet feeding devices 11–14 are arranged in multiple stages in a vertical direction, when a lower side sheet feeding device (for example, the sheet feeding device 14) in the multiple stages feeds a sheet, the sheet cannot be conveyed to the image forming part 2 unless each of the conveying rollers 24 of the sheet feeding devices 11, 12, and 13 located above the lower side feeding device 14 is driven. In this instance, the pick-up roller 23 and the feeding roller 21 of each sheet feeding unit 30 of the sheet feeding devices 11, 12, and 13 should preferably not be driven to rotate.

In the above-described image forming apparatus according to a preferred embodiment of the present invention, the sheet feeding units 30 of the sheet feeding devices 11–14 are independent from each other. Thus, when the lowermost sheet feeding device 14 feeds a sheet, all of the sheet feeding devices 11, 12, 13, and 14 are driven. At that time, the motor 31 of the sheet feeding unit 30 of the lowermost feeding device 14, which feeds the sheet, is switched from being driven to rotate in the forward direction to being driven to rotate in the reverse direction. However, the motors 31 of the sheet feeding units 30 of the other three feeding devices 11, 12, and 13 are driven to rotate in the reverse direction from the start. By controlling the motor 31 of each of the sheet feeding units 30 of the sheet feeding devices 11–14, a sheet fed from the lowermost sheet feeding device 14 is conveyed to the image forming part 2.

Figure 6:
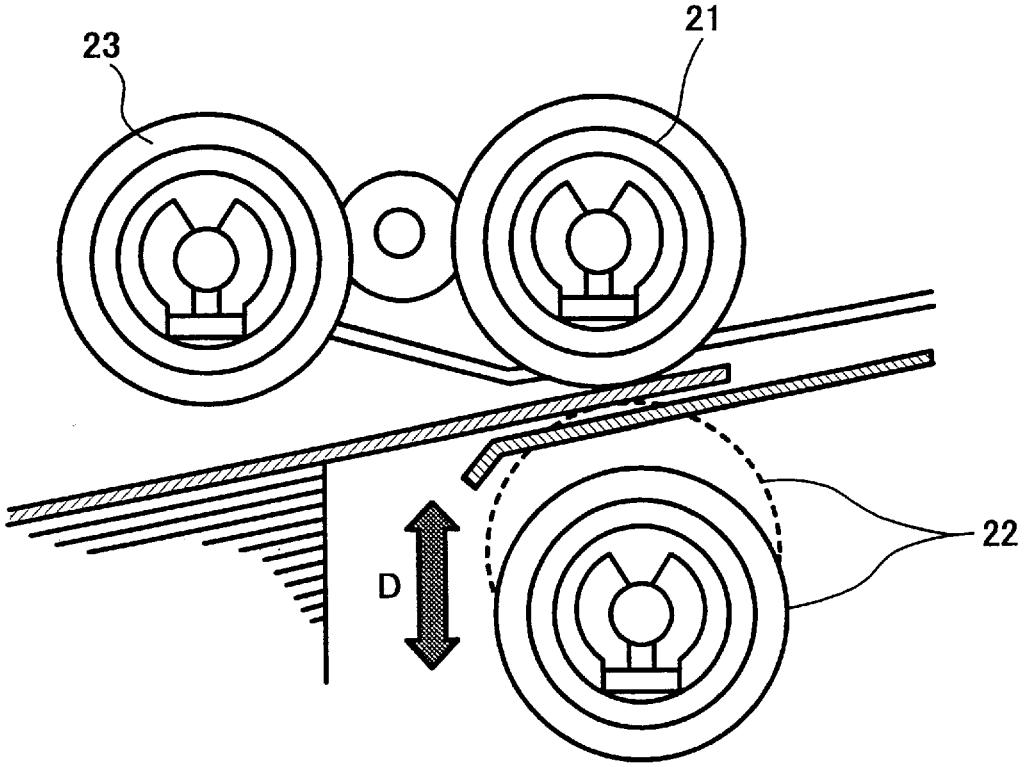
FIG. 6 is schematic drawing for explaining a contacting/separating operation of a separation roller relative to a feeding roller in the sheet feeding device.

In the image forming apparatus of the present invention illustrated in FIG. 1, each of the sheet feeding devices 11–14 also includes a contact/separation device to move the separation roller 22 in directions indicated by an arrow D in FIG. 6 to contact and separate from the feeding roller 21.

Figure 7:
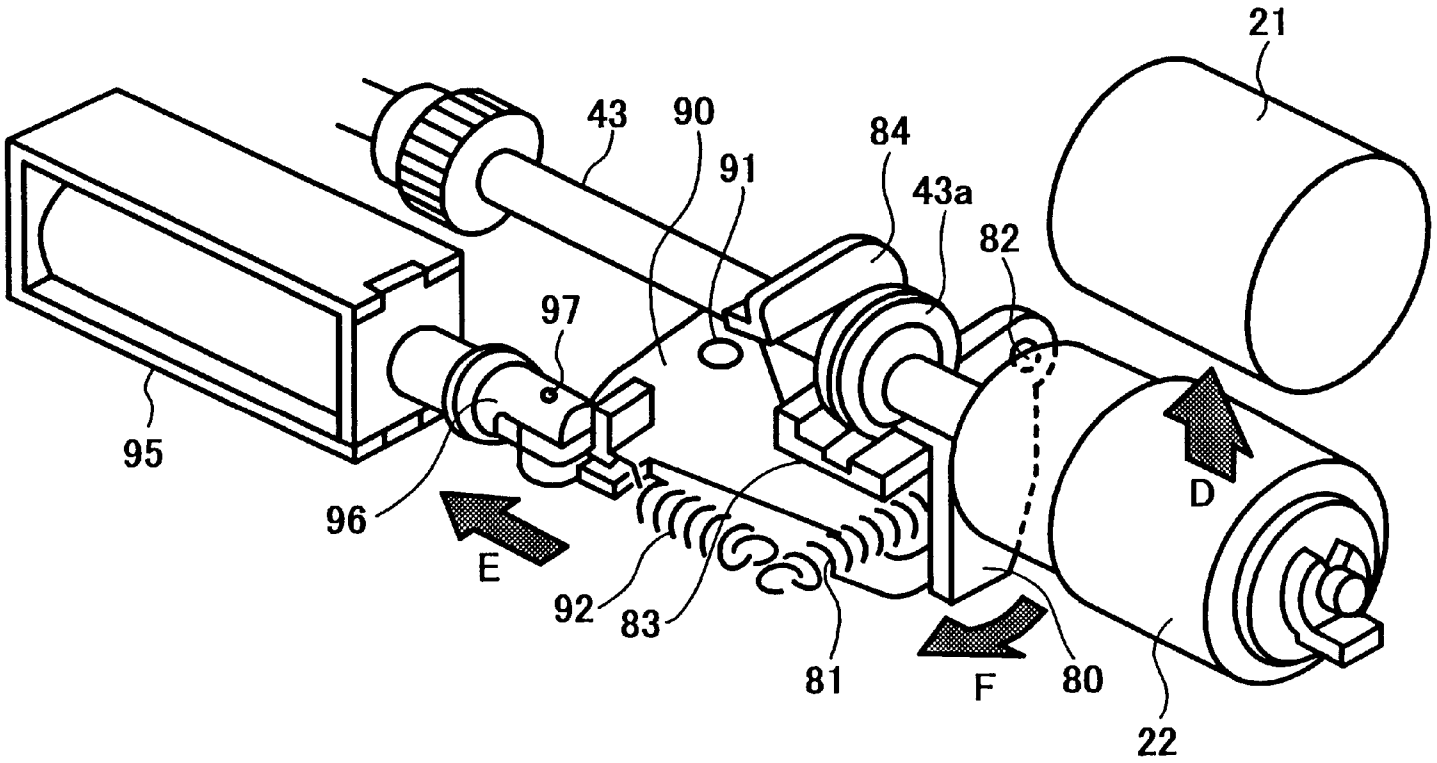
FIG. 7 is a perspective drawing illustrating an exemplary construction of a contact/separation device of the sheet feeding device to move the separation roller to contact and separate from the feeding roller.
Figure 8:
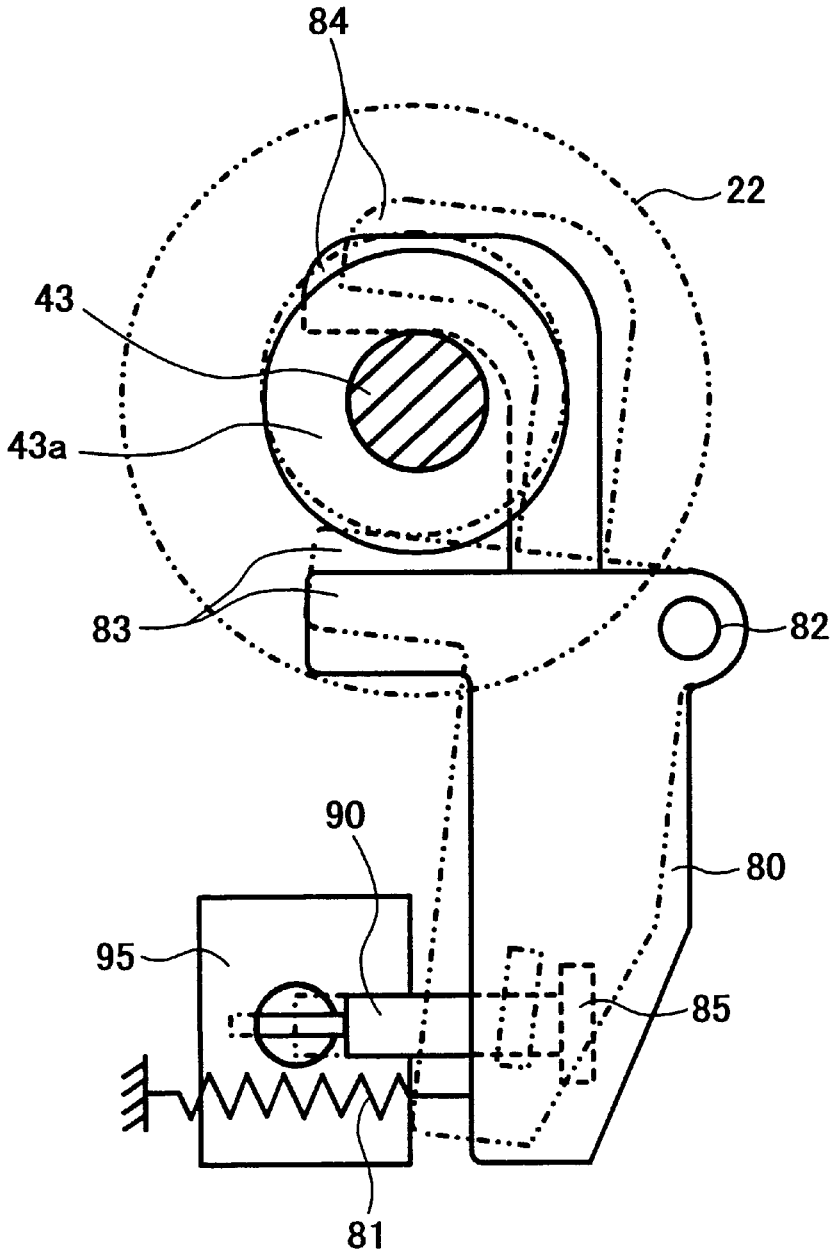
FIG. 8 is a schematic drawing for explaining an operation of the contact/separation device.

Turning now to FIG. 7, which is a schematic drawing illustrating an example of the contact/separation device, and FIG. 8 which is a schematic drawing explaining an operation of the contact/separation device. In FIGS. 7 and 8, a pressing lever 80 presses the separation roller 22 to move toward the feeding roller 21 so the separation roller 22 contacts the feeding roller 21 by a pulling force of a pressing spring 81. A releasing lever 90 releases the pressing force of the pressing lever 80. The pressing lever 80 is rotatably attached to the frame (not shown) of the sheet feeding unit 30 via a supporting axis 82.

An upwardly-pressing part 83 upwardly presses the separation roller 22 and a downwardly-pressing part 84 downwardly presses the separation roller 22 and are formed in the pressing lever 80. The pressing spring 81 applies to the pressing lever 80 a rotational force in the clockwise direction in FIG. 8 centering around the supporting axis 82. The upwardly-pressing part 83 contacts a roller 53*a* fixed to the driven axis 43 of the separation roller 22, so the pressing lever 80 presses the separation roller 22.

In addition, the releasing lever 90 is rotatably mounted to the frame (not shown) of the sheet feeding unit 30 via a supporting axis 91 (see FIG. 7), and is pressed by a releasing spring 92 to rotate around the supporting axis 91 in the counterclockwise direction in FIG. 7. A plunger 96 of a solenoid 95 is connected via a pin 97 with one end of the releasing lever 90 so as to be rotatable. Further, as illustrated in FIG. 8, the other end of the releasing lever 90 contacts a contact part 85 formed in the pressing lever 80.

When the solenoid 95 is turned off, the releasing lever 90 presses the contact part 85 of the pressing lever 80 by an elastic force of the releasing spring 92 of the releasing lever 90, and the downwardly-pressing part 84 of the pressing lever 80 contacts the driven axis 43 of the separation roller 22. Thereby, the separation roller 22 is held in a state of being separated from the feeding roller 21 while resisting an operation of the pressing spring 81.

When the solenoid 95 is turned on, the plunger 96 is pulled in the direction indicated by an arrow E in FIG. 7, and the releasing lever 90 is rotated centered around the supporting axis 91 in the clockwise direction indicated by an arrow F while resisting an operation of the releasing spring 92, so the releasing lever 90 separate from the contact part 85. Thereby, the pressing lever 80 rotates in the clockwise direction by an operation of the pressing spring 81, and upwardly moves the separation roller 22 via the upwardly-pressing part 83, so the separation roller 22 is pressed against and contacts the feeding roller 21.

As described above, in the above-described contact/separation device, the separation roller 22 is brought into contact with and separated from the feeding roller 21 by turning on/off the solenoid 95. Therefore, with the above-described contact/separation device at each of the sheet feeding devices 11–14, in each of the sheet feeding devices which are not feeding a sheet, even when the separation roller 22 and the conveying roller 24 are driven, separating the separation roller 22 from the feeding roller 21 avoids an unnecessary load on the separation roller 22.

Thus, the sheet feeding devices which are not feeding the sheet can be driven by a lower power than that for the sheet feeding device feeding the sheet. Specifically, when the power supplied to the stepping motor 31 of the sheet feeding unit 30 of the sheet feeding device feeding a sheet is set at a maximum phase current of 1.3A, for example, (hereinafter, a high power), the sheet can be satisfactorily conveyed even when the stepping motor 31 of the sheet feeding unit 30 of the sheet feeding devices not feeding the sheet is switched to a maximum phase current of 0.9A, for example, (hereinafter, a low power), which is lower than the high power for the sheet feeding device feeding the sheet.

Turning now to FIG. 9, which illustrates a table showing sheet feeding devices driven at low power when each of the sheet feeding devices 11–14 is selected. In the table of FIG. 9, the sheet feeding device marked with an "H" is the one selected for sheet feeding, and the motor 31 of the sheet feeding unit 30 is driven at the high power. The sheet feeding devices marked with an "L" are not selected for sheet feeding, and the motor 31 is driven at the lower power. The sheet feeding devices marked with an "x" are not driven.

Thus, in the above-described image forming apparatus according to an embodiment of the present invention, the consumption of electricity is reduced as compared to each of the motors 31 of the sheet feeding devices located above the sheet feeding device being driven at the same high power as that for the sheet feeding device selected for sheet feeding. Further, when a lower sheet feeding device of the sheet feeding devices 11–14 is selected for sheet feeding, a reduction in the consumption of electricity is greater.

Figure 10:
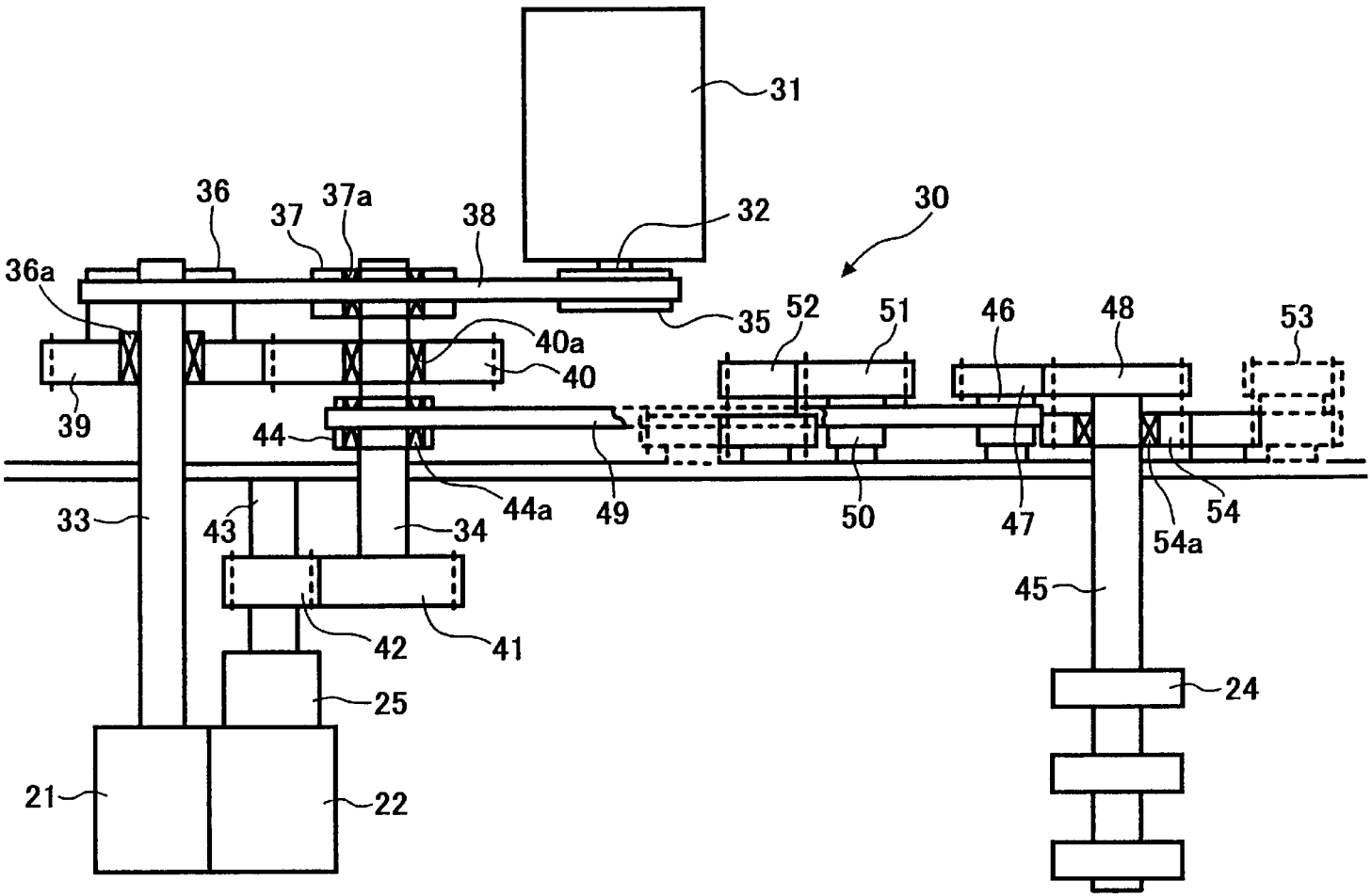
FIG. 10 is a schematic drawing of a sheet feeding unit of the sheet feeding device according to another preferred embodiment of the present invention.
Figure 11:
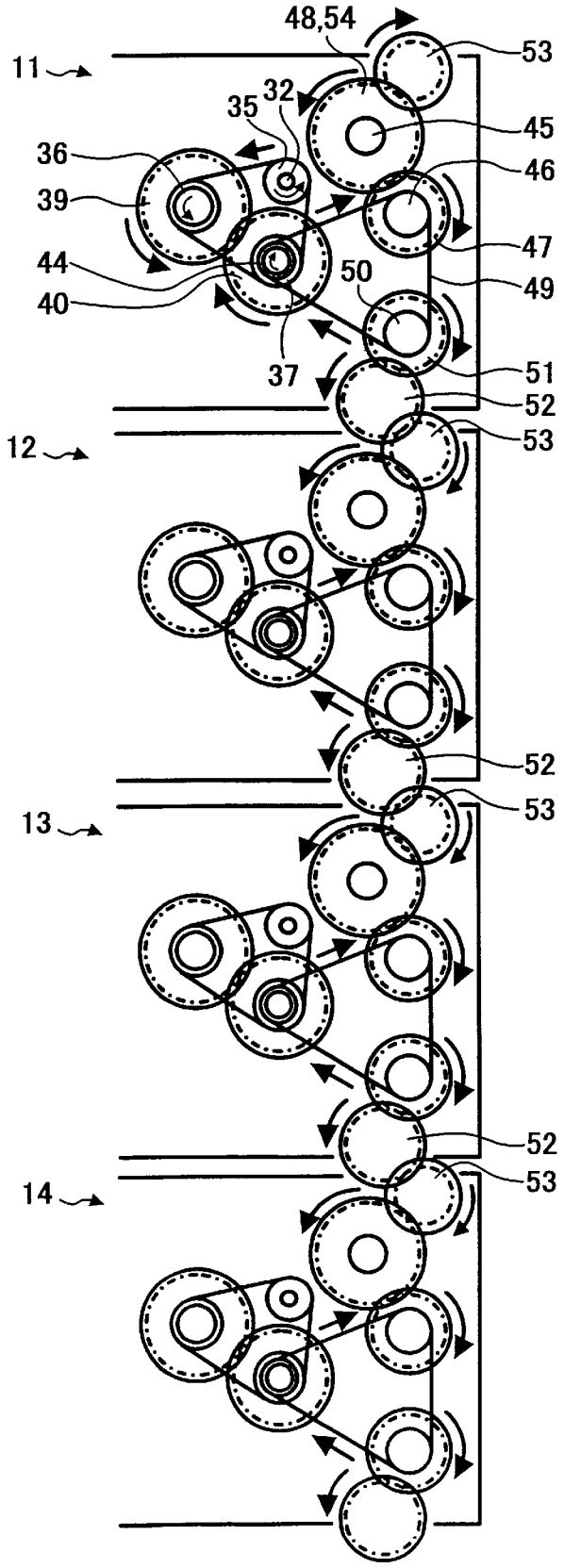
FIG. 11 is a front view of four sheet feeding devices arranged in multiple-stages in a vertical direction, each including the sheet feeding unit of FIG. 10.

Next, FIG. 10 is a schematic drawing of an example of the sheet feeding unit 30 according to another preferred embodiment of the present invention. FIG. 11 is a front view illustrating the sheet feeding devices 11–14, arranged in multiple-stages in a vertical direction, each including the sheet feeding unit 30 of FIG. 10. In FIGS. 10 and 11, the same or corresponding members as in the above-described embodiment are denoted by the same reference numerals. Further, the mechanism connecting the motor 31 with the driving axis 34 of the separation roller 22 is substantially the same as in the previous embodiment. Therefore, the description thereof is omitted.

As shown, a timing pulley 50 having a gear 51 is arranged below the timing pulley 46 having the gear 47, and the timing belt 49 is spanned around three timing pulleys, for example, the timing pulley 44, the timing pulley 46 having the gear 47, and the timing pulley 50 having the gear 51. A lower relaying gear 52 engages with the gear 51 of the timing pulley 50. Also, a gear 54 is provided to the roller axis 45 of the conveying roller 24 so as to substantially overlay with the gear 48. The gear 54 engages with an upper relaying gear 53.

Further, the lower relaying gear 52 of the sheet feeding unit 30 of the sheet feeding device 11, for example, engages with the upper relaying gear 53 of the sheet feeding unit 30 of the sheet feeding device 12 arranged below the sheet feeding device 11 as illustrated in FIG. 11. The gear 54 is also provided to the roller axis 45 of the conveying roller 24 via a one-way clutch 54*a*. When the gear 47 of the timing pulley 46 or the upper relaying gear 53 rotates, the one-way clutch 54*a* transmits each driving force so the conveying roller 24 rotates. However, because the one-way clutch 54*a* does not transmit rotation of the roller axis 45 of the conveying roller 24 to the upper relaying gear 53 and the gear 47, the upper relaying gear 53 is never rotated by rotation of the conveying roller 24.

Thus, in each of the sheet feeding devices 11–14 illustrated in FIG. 11, when the upper relaying gear 53 of the sheet feeding unit 30 of the sheet feeding device 12, for example, is rotated by receiving a driving force of the lower relaying gear 52 of the sheet feeding unit 30 of the sheet feeding device 11 located immediately above, the conveying roller 24 of the sheet feeding unit 30 of the sheet feeding device 12 rotates. When the gear 48 of the roller axis 45 of the conveying roller 24 rotates, the timing pulley 46 having the gear 47 engaging with the gear 48 rotates, and the timing belt 49 moves in the clockwise direction in FIG. 11. Accordingly, because the timing pulley 50 having the gear 51 rotates, the lower relaying gear 52 engaging with the gear 51 of the timing pulley 50 rotates. Further, a driving force caused by movement of the timing belt 49 is not transmitted to the driving axis 34 of the separation roller 22, because as illustrated in FIG. 10, a one-way clutch 44*a* is provided to the timing pulley 44 so the movement of the timing belt 49 in the clockwise direction is not transmitted to the driving axis 34 of the separation roller 22.

Thus, when the lower relaying gear 52 of the feeding unit 30 of the sheet feeding device 11 at the uppermost stage of the multiple stages is rotated, the conveying roller 24 of each feeding unit 30 of the other sheet feeding devices below the upper sheet feeding device 11 can be rotated. Therefore, when the sheet feeding device 14 at the lowermost stage feeds a sheet, the uppermost sheet feeding device 11 and the lowermost sheet feeding device 14 are driven, and without driving the intermediate sheet feeding devices 12 and 13, the conveying roller 24 of each sheet feeding unit 30 of the intermediate sheet feeding devices 12 and 13 are driven by receiving a driving force of the sheet feeding unit 30 of the uppermost sheet feeding device 11.

Accordingly, as indicated by a table of FIG. 12, because sheet feeding can be performed by only driving the uppermost sheet feeding device 11 and one of the other sheet feeding devices 12, 13 and 14 selected for sheet feeding, the reduction of power consumption increases as the number of stages of sheet feeding devices increases. Further, the motor 31 of the feeding unit 30 of the uppermost sheet feeding device 11 rotates only in the reverse direction, unless the uppermost sheet feeding device 11 is selected for sheet feeding.

Figure 13:
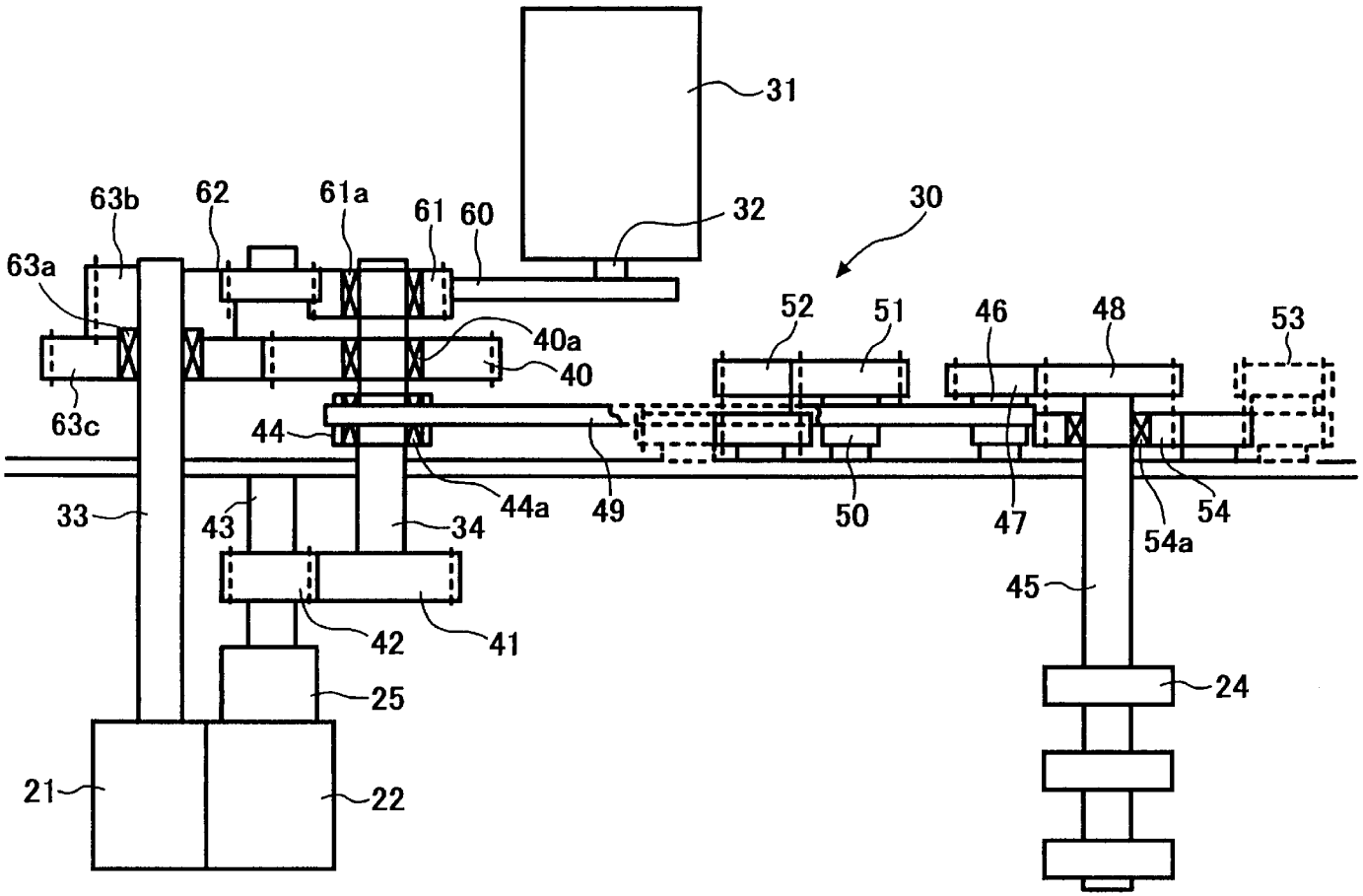
FIG. 13 is a schematic drawing of a sheet feeding unit of the sheet feeding device according to still another preferred embodiment of the present invention, which drives a feeding roller and a separation roller via a series of gears.

In the above-described embodiment, a driving force of the motor 31 is transmitted to the feeding roller 21 and the separation roller 22 using a belt and gears so the feeding roller 21 and the separation roller 22 are driven to rotate. However, the driving force of the motor 31 can be transmitted to the feeding roller 21 and the separation roller 22 using a series of gears. FIG. 13 illustrates an exemplary construction of the sheet feeding unit 30 in which a driving force of the motor 31 is transmitted to the feeding roller 21 and the separation roller 23 via a series of gears.

In FIG. 13, a gear 60 is provided to the output axis 32 of the motor 31, and the gear 60 engages with a gear 61 provided to the driving axis 34 of the separation roller 22 via a one-way clutch 61*a*. The gear 61 engages, via an idle gear 62, with a small-diameter two-step gear 63*b* provided to the driving axis 33 of the feeding roller 21 via a one-way clutch 63*a*. Further, a large-diameter two-step gear 63*c* engages with a gear 40 provided to the driving axis 34 via a one-way clutch 40*a*.

In this instance, the one-way clutch 61*a* is configured such that rotation of the gear 61 is transmitted to the driving gear 34 of the separation roller 22 when the gear 61 is rotated with rotation of the motor 31 in the reverse direction, and the rotation of the gear 61 is not transmitted to the driving gear 34 when the motor 31 rotates in the forward direction. Further, the one-way clutch 63*a* is configured such that rotation of the gear 61 is transmitted to the driving axis 33 of the feeding roller 21 when the gear 61 is rotated with rotation of the motor 31 in the forward direction. In addition, the one-way clutch 40*a* is configured such that driving of the gear 40 is transmitted to the driving axis 34 of the separation roller 22 when the gear 40 is driven via the two-step gears 63*b* and 63*c*.

In the sheet feeding unit 30 configured as described above, when the motor 31 rotates in the forward direction, a driving force of the motor 31 is transmitted via the gear 61, the idle gear 62 and the two-step gears 63*b* and 63*c*, so the driving axis 33 of the feeding roller 21 is driven to rotate. Further, the gear 40 engaging with the two-step gears 63*b* and 63*c* is rotated so the driving axis 34 of the separation roller 22 is driven to rotate. When the motor 31 rotates in the reverse direction, the driving axis 34 of the separation roller 22 is driven to rotate by the gear 61. However, the driving axis 33 of the feeding roller 21 is not driven to rotate, because the one-way clutch 63*a* provided at the two-step gears 63*b* and 63*c* does not transit the driving force of the motor 31 when the motor 31 rotates in the reverse direction.

In the above-described embodiment, substantially the same effect as in the previous embodiments is obtained. Further, in the above-described embodiment, the part of the sheet feeding unit 30 downstream of the driving axis 34 of the separation roller 22 in the direction in which a driving force of the motor 31 is transmitted is substantially the same as that in the previous embodiments, and therefore the description thereof is omitted.

Numerous additional modifications and variations of the present invention are possible in light of the above teachings. It is therefore to be understood that within the scope of the appended claims, the present invention may be practiced otherwise than as specifically described herein.

What is claimed is:

1. A sheet feeding device, comprising:

a sheet tray configured to accommodate stacked sheets; and a sheet feeding unit configured to feed the stacked sheets in the sheet tray one by one, the sheet feeding unit including, a feeding roller configured to be driven to rotate in a sheet feeding direction in which each of the sheets is fed, a separation roller configured to be pressed against the feeding roller when feeding each of the sheets and to be driven to rotate, via a torque limiter, in a direction opposite the sheet feeding direction, the separation roller being rotated by rotation of the feeding roller in the sheet feeding direction when a single sheet of the stacked sheets is sandwiched between the feeding roller and the separation roller, a conveying member arranged downstream from the feeding roller in the sheet feeding direction, a driving source configured to drive the feeding roller, the separation roller, and the conveying member, and a driving force transmission mechanism configured to transmit a driving force of the driving source to each of the feeding roller, the separation roller and the conveying member so the separation roller and the conveying member are driven in conjunction with each other.

2. The sheet feeding device of claim 1, wherein the driving source includes a reversible motor configured to be switched between being driven to rotate in first and second directions.

3. The sheet feeding device of claim 2, wherein the driving transmission mechanism is configured to transmit the driving force of the motor so the feeding roller, the separation roller, and the conveying member are driven when the driving source is driven to rotate in the first direction, and so the feeding roller is not driven and the separation roller and the conveying member are driven in conjunction with each other when the driving source is driven to rotate in the second direction.

4. The sheet feeding device of claim 2, wherein the separation roller and the conveying member are configured to be continuously driven in conjunction with each other by the driving source from when each sheet starts to be fed by the feeding roller until the sheet passes the conveying member.

5. The sheet feeding device of claim 2, wherein the driving source is switched from being driven to rotate in the first direction to being driven to rotate in the second direction while the sheet is being sandwiched between the feeding roller and the separation roller.

6. The sheet feeding device of claim 2, wherein the driving force transmission mechanism includes driving force transmission members and mechanical one-way clutches.

7. The sheet feeding device of claim 6, wherein the driving force transmission mechanism include gears and a belt.

8. The sheet feeding device of claim 7, wherein the driving force transmission mechanism transmits the driving force of the driving source to the separation roller via the belt and the gears when the driving source is driven to rotate in the first direction, and the driving force transmission mechanism transmits the driving force of the driving source to the separation roller via the belt when the driving source is driven to rotate in the second direction.

9. The sheet feeding device of claim 6, wherein the driving force transmission members include a series of gears.

10. The sheet feeding device of claim 9, wherein the driving force transmission mechanism transmits the driving force of the driving source to the separation roller via a first portion of the series of gears when the driving source is driven to rotate in the first direction, and the driving force transmission mechanism transmits the driving force of the driving source to the separation roller via a second portion of the series of gears when the driving source is driven to rotate in the second direction, the first portion of the series of gears being greater in number than the second portion of the series of gears by an odd number.

11. The sheet feeding device of claim 2, wherein the driving force transmission mechanism includes a first rotation transmission route configured to transmit the driving force of the driving source when the driving source is driven to rotate in the first direction, and includes a second rotation transmission route configured to transmit the driving force of the driving source when the driving source is driven to rotate in the second direction.

12. The sheet feeding device of claim 11, wherein the driving force transmission mechanism includes a belt and gears, and wherein the first rotation transmission route is configured to transmit the driving force of the driving source to the feeding roller via the belt and then from the feeding roller to the reverse roller via the gears, and the second rotation transmission route is configured to transmit the driving force of the driving source to the separation roller via the belt.

13. The sheet feeding device of claim 11, wherein the driving force transmission mechanism includes a series of gears, and wherein the first rotation transmission route is configured to transmit the driving force of the driving source to the separation roller via a first portion of the series of gears, and the second rotation transmission route is configured to transmit the driving force of the driving source to the separation roller via a second portion of the series of gears, the first portion of the series of gears being greater in number than the second portion of the series of gears by an odd number.

14. The sheet feeding device of claim 1, wherein the feeding unit is detachable from the sheet feeding device.

15. An image forming apparatus, comprising:

an image forming unit configured to form a toner image on a photoconductor; and a sheet feeding device including a sheet tray configured to accommodate stacked sheets and a sheet feeding unit configured to feed the stacked sheets in the sheet tray one by one toward the image forming unit so the toner image is transferred onto each sheet at the image forming unit, the sheet feeding unit including, a feeding roller configured to be driven to rotate in a sheet feeding direction in which each of the sheets is fed, a separation roller configured to be pressed against the feeding roller when feeding each of the sheets and to be driven to rotate, via a torque limiter, in a direction opposite the sheet feeding direction, the separation roller being rotated by rotation of the feeding roller in the sheet feeding direction when a single sheet of the stacked sheets is sandwiched between the feeding roller and the separation roller, a conveying member arranged downstream from the feeding roller in the sheet feeding direction, a driving source configured to drive the feeding roller, the separation roller, and the conveying member, and a driving force transmission mechanism configured to transmit a driving force of the driving source to each of the feeding roller, the separation roller and the separation member so the separation roller and the conveying member are driven in conjunction with each other.

16. The image forming apparatus of claim 15, wherein the driving source of the sheet feeding unit includes a reversible motor configured to be switched between being driven to rotate in first and second directions.

17. The image forming apparatus of claim 16, wherein the driving transmission mechanism of the sheet feeding unit is configured to transmit the driving force of the motor so the feeding roller, the separation roller, and the conveying member of the sheet feeding unit are driven when the driving source is driven to rotate in the first direction, and so the feeding roller is not driven and the separation roller and the conveying member are driven in conjunction with each other when the driving source is driven to rotate in the second direction.

18. The image forming apparatus of claim 16, wherein the separation roller and the conveying member of the feeding unit are configured to be continuously driven in conjunction with each other by the driving source from when each sheet starts to be fed by the feeding roller until the sheet passes the conveying member.

19. The image forming apparatus of claim 16, wherein the driving source is switched from being driven to rotate in the first direction to being driven to rotate in the second direction while the sheet is being sandwiched between the feeding roller and the separation roller.

20. The image forming apparatus of claim 16, wherein the driving force transmission mechanism includes driving force transmission members and mechanical one-way clutches.

21. The image forming apparatus of claim 20, wherein the driving force transmission members include gears and a belt.

22. The image forming apparatus of claim 21, wherein the driving force transmission mechanism transmits the driving force of the driving source to the separation roller via the belt and the gears when the driving source is driven to rotate in the first direction, and the driving force transmission mechanism transmits the driving force of the driving source to the separation roller via the belt when the driving source is driven to rotate in the second direction.

23. The image forming apparatus of claim 20, wherein the driving force transmission members includes a series of gears.

24. The image forming apparatus of claim 23, wherein the driving force transmission mechanism transmits the driving force of the driving source to the separation roller via a first portion of the series of gears when the driving source is driven to rotate in the first direction, and the driving force transmission mechanism transmits the driving force of the driving source to the separation roller via a second portion of the series of gears when the driving source is driven to rotate in the second direction, the first portion of the series of gears is greater in number than the second portion of the series of gears by an odd number.

25. The image forming apparatus of claim 16, wherein the driving force transmission mechanism includes a first rotation transmission route configured to transmit the driving force of the driving source when the driving source is driven to rotate in the first direction, and includes a second rotation transmission route configured to transmit the driving force of the driving source when the driving source is driven to rotate in the second direction.

26. The image forming apparatus of claim 25, wherein the driving force transmission mechanism includes a belt and gears, and wherein the first rotation transmission route is configured to transmit the driving force of the driving source to the feeding roller via the belt and then from the feeding roller to the reverse roller via the gears, and the second rotation transmission route is configured to transmit the driving force of the driving source to the separation roller via the belt.

27. The image forming apparatus of claim 25, wherein the driving force transmission mechanism includes a series of gears, and wherein the first rotation transmission route is configured to transmit the driving force of the driving source to the separation roller via a first portion of the series of gears, and the second rotation transmission route is configured to transmit the driving force of the driving source to the separation roller via a second portion of the series of gears, the first portion of the series of gears being greater in number than the second portion of the series of gears by an odd number.

28. The image forming apparatus of claim 15, wherein the feeding unit is detachable from the sheet feeding device.

29. An image forming apparatus, comprising:

an image forming unit configured to form a toner image on a photoconductor; and a plurality of sheet feeding devices, each including a sheet tray configured to accommodate stacked sheets and a sheet feeding unit configured to feed the stacked sheets in the sheet tray one by one toward the image forming unit so the toner image is transferred onto each sheet at the image forming unit, each of the plurality sheet feeding unit including, a feeding roller configured to be driven to rotate in a sheet feeding direction in which each of the sheets is fed, a separation roller configured to be pressed against the feeding roller when feeding each of the sheets and to be driven to rotate, via a torque limiter, in a direction opposite the sheet feeding direction, the separation roller being rotated by rotation of the feeding roller in the sheet feeding direction when a single sheet of the stacked sheets is sandwiched between the feeding roller and the separation roller, a conveying member arranged downstream from the feeding roller in the sheet feeding direction, a driving source configured to drive the feeding roller, the separation roller, and the conveying member, and a driving force transmission mechanism configured to transmit a driving force of the driving source to each of the feeding roller, the separation roller and the conveying member so the separation roller and the conveying member are driven in conjunction with each other.

30. The image forming apparatus of claim 29, wherein the driving source of each sheet feeding unit of the plurality of sheet feeding devices includes a reversible motor configured to be switched between being driven to rotate in first and second directions.

31. The image forming apparatus of claim 30, wherein the driving transmission mechanism of each sheet feeding unit of the plurality of sheet feeding devices is configured to transmit the driving force of the motor so the feeding roller, the separation roller, and the conveying member are driven when the driving source is driven to rotate in the first direction, and so the feeding roller is not driven and the separation roller and the conveying member are driven in conjunction with each other when the driving source is driven to rotate in the second direction.

32. The image forming apparatus of claim 30, wherein the separation roller and the conveying member of each sheet feeding unit of the plurality of sheet feeding devices are configured to be continuously driven in conjunction with each other by the driving source from when each sheet starts to be fed by the feeding roller until the sheet passes the conveying roller.

33. The image forming apparatus of claim 30, wherein the driving source is switched from being driven to rotate in the first direction to being driven to rotate in the second direction while the sheet is being sandwiched between the feeding roller and the separation roller.

34. The image forming apparatus of claim 30, wherein the driving force transmission mechanism of each sheet feeding unit of the plurality of sheet feeding devices includes driving force transmission members and mechanical one-way clutches.

35. The image forming apparatus of claim 34, wherein the driving force transmission members include gears and a belt.

36. The image forming apparatus of claim 35, wherein the driving force transmission mechanism transmits the driving force of the driving source to the separation roller via the belt and the gears when the driving source is driven to rotate in the first direction, and the driving force transmission mechanism transmits the driving force of the driving source to the separation roller via the belt when the driving source is driven to rotate in the second direction.

37. The image forming apparatus of claim 34, wherein the driving force transmission members include a series of gears.

38. The image forming apparatus of claim 37, wherein the driving force transmission mechanism transmits the driving force of the driving source to the separation roller via a first portion of the series of gears when the driving source is driven to rotate in the first direction, and the driving force transmission mechanism transmits the driving force of the driving source to the separation roller via a second portion of the series of gears when the driving source is driven to rotate in the second direction, the first portion of the series of gears is greater in number than the second portion of the series of gears by an odd number.

39. The image forming apparatus of claim 30, wherein the driving force transmission mechanism includes a first rotation transmission route configured to transmit the driving force of the driving source when the driving source is driven to rotate in the first direction, and includes a second rotation transmission route configured to transmit the driving force of the driving source when the driving source is driven to rotate in the second direction.

40. The image forming apparatus of claim 39, wherein the driving force transmission mechanism includes a belt and gears, and wherein the first rotation transmission route is configured to transmit the driving force of the driving source to the feeding roller via the belt and then from the feeding roller to the reverse roller via the gears, and the second rotation transmission route is configured to transmit the driving force of the driving source to the separation roller via the belt.

41. The image forming apparatus of claim 39, wherein the driving force transmission mechanism includes a series of gears, and wherein the first rotation transmission route is configured to transmit the driving force of the driving source to the separation roller via a first portion of the series of gears, and the second rotation transmission route is configured to transmit the driving force of the driving source to the separation roller via a second portion of the series of gears, the first portion of the series of gears being greater in number than the second portion of the series of gears by an odd number.

42. The image forming apparatus of claim 29, wherein the sheet feeding unit of each of the plurality of sheet feeding devices is detachable from the sheet feeding device.

43. The image forming apparatus of claim 30, wherein the plurality of sheet feeding devices are arranged in multiple stages in a vertical direction in parallel with each other, and wherein the sheet feeding units of the plurality of sheet feeding devices are individually driven such that each sheet fed from one of the plurality of sheet feeding devices is fed toward the image forming unit via the conveying member of each of other sheet feeding devices of the plurality of sheet feeding devices located above the sheet feeding device from which the sheet is fed.

44. The image forming apparatus of claim 43, wherein the sheet feeding units of any neighboring sheet feeding devices of the plurality of sheet feeding devices are connected with each other so the driving force of the driving source of the sheet feeding unit of the sheet feeding device of the neighboring sheet feeding devices, located at a lower side, is not transmitted to the feeding unit of the sheet feeding device of the neighboring feeding devices, located at an upper side, and the driving force of the driving source of the feeding unit of the sheet feeding device of the neighboring sheet feeding devices, located at the upper side, is transmitted to the sheet feeding unit of the sheet feeding device of the neighboring sheet feeding devices, located at the lower side.

45. The image forming apparatus of claim 44, wherein the separation roller and the conveying member of the feeding unit of an uppermost sheet feeding device of the plurality of sheet feeding devices and the separation roller and the conveying member of the feeding unit of the sheet feeding device of the plurality of sheet feeding devices, feeding the sheet, are respectively driven in conjunction with each other, and the separation roller and the conveying member of each of the sheet feeding units of other sheet feeding devices of the plurality of sheet feeding devices, not feeding the sheet, are not driven in conjunction with each other and only the conveying member is driven.

46. The image forming apparatus of claim 43, wherein the driving source of the sheet feeding unit of the sheet feeding device of the plurality of sheet feeding devices, feeding the sheet, is driven by a predetermined power, and the driving source of the sheet feeding unit of each of other sheet feeding devices located above the sheet feeding device feeding the sheet is driven at a power smaller than the predetermined power.

47. The image forming apparatus of claim 46, wherein the driving source of the sheet feeding unit of each of the other sheet feeding devices located below the sheet feeding device feeding the sheet is not driven.

48. The image forming apparatus of claim 46, wherein each of the sheet feeding devices includes a contact/separation device configured to bring the separation roller into contact with the feeding roller and to separate the separation roller from the feeding roller, and wherein the contact/separation device is configured to separate the separation roller from the feeding roller except when the sheet feeding device feeds each of the stacked sheets.

49. A sheet feeding device, comprising:

means for accommodating stacked sheets; and feeding means for feeding the stacked sheets in the sheet accommodating means one by one, the sheet feeding means including, feeding roller means for rotating in a sheet feeding direction in which each of the stacked sheets is fed, separation roller means for pressing against the feeding roller means when feeding each of the stacked sheets and for rotating in a direction opposite the sheet feeding direction, the separation roller means being rotated by rotation of the feeding roller means in the sheet feeding direction when a single sheet of the stacked sheets is sandwiched between the feeding roller means and the separation roller means, means for conveying the sheet, arranged downstream of the feeding roller means in the sheet feeding direction, means for driving the feeding roller means, the separation roller means, and the conveying means, and means for transmitting a driving force of the driving means to each of the feeding roller means, the separation roller means and the conveying means so the separation roller means and the conveying means are driven in conjunction with each other.

50. An image forming apparatus, comprising:

means for forming a toner image on a photoconductor; and sheet feeding means for feeding stacked sheets accommodated in a sheet accommodating means one by one toward the image forming means so the toner image is transferred onto each sheet at the image forming means, the sheet feeding means including, feeding roller means for rotating in a sheet feeding direction in which each of the stacked sheets is fed, separation roller means for pressing against the feeding roller means when feeding each of the stacked sheets and for rotating in a direction opposite the sheet feeding direction, the separation roller means being rotated by rotation of the feeding roller means in the sheet feeding direction when a single sheet of the stacked sheets is sandwiched between the feeding roller means and the separation roller means, means for conveying the sheet, arranged downstream of the feeding roller means in the sheet feeding direction, means for driving the feeding roller means, the separation roller means, and the conveying means, and means for transmitting a driving force of the driving means to the feeding roller means, the separation roller means and the conveying means so the separation roller means and the conveying means are driven in conjunction with each other.

51. An image forming apparatus, comprising:

means for forming a toner image on a photoconductor; and a plurality of sheet feeding means for feeding stacked sheets accommodated in a sheet accommodating means one by one toward the image forming means so the toner image is transferred onto each sheet at the image forming means, the sheet feeding means including, feeding roller means for rotating in a sheet feeding direction in which each of the stacked sheets is fed, separation roller means for pressing against the feeding roller means when feeding each of the stacked sheets and for rotating in a direction opposite the sheet feeding direction, the separation roller means being rotated by rotation of the feeding roller means in the sheet feeding direction when a single sheet of the stacked sheets is sandwiched between the feeding roller means and the separation roller means, means for conveying the sheet, arranged downstream of the feeding roller means in the sheet feeding direction, means for driving the feeding roller means, the separation roller means, and the conveying means, and means for transmitting a driving force of the driving means to each of the feeding roller means, the separation roller means and the conveying means so the separation roller means and the conveying means are driven in conjunction with each other.

52. A method of feeding stacked sheets one by one in a sheet feeding device having a feeding roller, a separation roller and a conveying member, comprising:

driving a motor to rotate in a first direction and transmitting a driving force of the motor with a driving force transmitting mechanism to the feeding roller, the separation roller and the conveying member so the feeding roller is driven to rotate in a sheet feeding direction, the separation roller is driven to rotate in a direction opposite the sheet feeding direction, and the conveying member is driven to rotate in the sheet feeding direction; and driving the motor to rotate in a second direction and transmitting the driving force of the motor to the feeding roller, the separation roller and the conveying member so the feeding roller is stopped, and the separation roller and the conveying roller are driven to rotate in respective directions in conjunction with each other.

* * * * *